US008794628B1

(12) United States Patent
Fousteris et al.

(10) Patent No.: US 8,794,628 B1
(45) **Date of Patent: *Aug. 5, 2014**

(54) METHOD AND APPARATUS FOR PLAYING A POKER-STYLE GAME

(71) Applicants: Marc Fousteris, Jupiter, FL (US); George Zarcadoolas, Pompano Beach, FL (US)

(72) Inventors: Marc Fousteris, Jupiter, FL (US); George Zarcadoolas, Pompano Beach, FL (US)

(73) Assignee: George Zarcadoolas, Pompano Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/671,723

(22) Filed: Nov. 8, 2012

Related U.S. Application Data

(63) Continuation-in-part of application No. 13/440,466, filed on Apr. 5, 2012.

(51) Int. Cl.
*A63F 1/00* (2006.01)

(52) U.S. Cl.
USPC ..... 273/292; 463/13

(58) Field of Classification Search
CPC ..... A63F 1/00; G07F 17/3293
USPC ..... 273/292; 463/13
See application file for complete search history.

(56) References Cited

U.S. PATENT DOCUMENTS

| | | | | |
|---|---|---|---|---|
| 5,332,228 | A * | 7/1994 | Schultz | 463/13 |
| 2005/0082758 | A1 | 4/2005 | Sklansky | |
| 2008/0108412 | A1 | 5/2008 | Snow | |
| 2009/0134577 | A1 * | 5/2009 | Finnerman | 273/292 |
| 2010/0194046 | A1 * | 8/2010 | Fousteris | 273/292 |
| 2012/0139182 | A1 * | 6/2012 | Poon | 273/292 |

* cited by examiner

*Primary Examiner* — Michael Dennis
(74) *Attorney, Agent, or Firm* — Jeffrey A. Proehl; Woods, Fuller, Schultz & Smith, P.C.

(57) ABSTRACT

A method and apparatus for playing a poker-style game including dealing cards to an initial dealer hand with one card face up and one card face down, and dealing cards to an initial player hand. The method may include receiving a further wager from the player that comprises a call wager from the player or a surrender by the player of a fraction of the raise wager, and dealing at least one community card face up. The method may include determining a player hand ranking by forming a best player hand as a subset of the initial player hand and the at least one community card, determining a dealer hand ranking by forming a best dealer hand as a subset of the initial dealer hand and the at least one community card, and comparing the player hand ranking and dealer hand ranking to determine a winner.

19 Claims, 10 Drawing Sheets

WILDCARD BONUS PAYOUT TABLE
(ACE HIGH OR PAIR)

---

TWO WILD CARDS. 100 to 1
POCKET ACES 30 to 1
ACE KING SUITED 25 to 1
ACE QUEEN/JACK SUITED 15 to 1
ACE KING 10 to 1
KINGS, QUEENS, JACKS 6 to 1
ACE QUEEN, ACE JACK 5 to 1
PAIR 2s - 10s. 2 to 1
ACE - HIGH 1 to 1

FIG. 2

Blind Wager Pay Table I

| Hand Type | Payout |
|---|---|
| Pocket Aces | 25 to 1 |
| AK Suited | 10 to 1 |
| AQ or AJ Suited | 6 to 1 |
| AK Unsuited | 5 to 1 |
| KK, QQ or JJ | 4 to 1 |
| AQ or AJ Unsuited | 3 to 1 |
| Pair 2's thru 10's | 2 to 1 |
| Suited Cards | 1 to 1 |

FIG. 7A

Blind Wager Pay Table II

| Hand Type | Payout |
|---|---|
| Pocket Aces | 30 to 1 |
| AK Suited | 25 to 1 |
| AQ or AJ Suited | 15 to 1 |
| AK Unsuited | 10 to 1 |
| KK, QQ or JJ | 6 to 1 |
| AQ or AJ Unsuited | 5 to 1 |
| Pair 2's thru 10's | 2 to 1 |
| Ace High | 1 to 1 |

FIG. 7B

Blind Wager Pay Table III

| Hand Type | Payout |
|---|---|
| Pocket Aces | 30 to 1 |
| AK Suited | 20 to 1 |
| AQ or AJ Suited | 15 to 1 |
| AK Unsuited | 10 to 1 |
| KK, QQ or JJ | 6 to 1 |
| AQ or AJ Unsuited | 5 to 1 |
| Pair 2's thru 10's | 2 to 1 |
| Ace High | 1 to 1 |

FIG. 7C

Board Wager Pay Table I

| Hand Type | Payout |
|---|---|
| Royal Flush | 50 to 1 |
| Straight Flush | 20 to 1 |
| 4 of a Kind | 10 to 1 |
| Full House | 1 to 1 |
| Flush | 1 to 1 |

FIG. 8A

Board Wager Pay Table II

| Hand Type | Payout |
|---|---|
| Royal Flush | 50 to 1 |
| Straight Flush | 20 to 1 |
| 4 of a Kind | 3 to 1 |
| Full House | 1.5 to 1 |
| Flush | 1 to 1 |

FIG. 8B

METHOD AND APPARATUS FOR PLAYING A POKER-STYLE GAME

REFERENCE TO RELATED APPLICATION

This application is a continuation in part of U.S. application Ser. No. 13/440,466, filed on Apr. 5, 2012, now pending.

BACKGROUND

Field

The present disclosure relates to poker-style games and more particularly pertains to a new method of playing a poker-style game with options and choices by the player that enhances the challenges faced by the player as well as making the game more interesting for the player.

SUMMARY in one aspect, the disclosure relates to a method of playing a poker-style game between a player and a dealer. The method may comprise providing a game apparatus including at least one deck of physical playing cards and dealing cards to an initial dealer hand of the dealer if at least one player has placed a blind wager, with the dealing including placing at least one card face up and at least one card face down. The method may comprise dealing cards to an initial player hand of at least one player if said player has placed a PEEK wager and dealing cards face up to a community card hand if at least one player has placed a raise wager. The method may also comprise turning over the at least one face down card of the dealer's hand if at least one player: places a board wager or surrenders a fraction of one of said player's previously placed wagers. The method may further comprise dealing at least one further card face up to the community card hand if at least one player has placed a board wager or surrendered a fraction of one of said player's previously placed wagers, determining a player hand ranking by forming a best player hand as a subset of the initial player hand and the at least one community card, and determining a dealer hand ranking by forming a best dealer hand as a subset of the initial dealer hand and the at least one community card. The method may also include comparing the player hand ranking and the dealer hand ranking to determine a winner.

In another aspect, the present disclosure relates to a method of playing a poker-style game between a player and a dealer, and may comprise providing a game apparatus including at least one deck of physical playing cards, dealing cards to an initial dealer hand of the dealer if the player has placed a blind wager with the dealing including placing at least one card face up and at least one card face down, and dealing cards to an initial player hand of the player if the player has placed a raise wager. The method may also include receiving a further wager from the player in which the further wager comprises a call wager from the player or a surrender by the player of a fraction of the raise wager. The method may further include dealing at least one community card face up if the player has placed the further wager, determining a player hand ranking by forming a best player hand as a subset of the initial player hand and the at least one community card, determining a dealer hand ranking by forming a best dealer hand as a subset of the initial dealer hand and the at least one community card, and comparing the player hand ranking and the dealer hand ranking to determine a winner.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein:

FIG. 2 is a schematic diagram of an illustrative payout table usable with the methods of the disclosure.

FIG. 7A is a schematic diagram of one illustrative payout table for a blind wager that is usable with the methods of the disclosure.

FIG. 7B is a schematic diagram of another illustrative payout table for a blind wager that is usable with the methods of the disclosure.

FIG. 7C is a schematic diagram of another illustrative payout table for a blind wager that is usable with the methods of the disclosure.

FIG. 8A is a schematic diagram of one illustrative payout table for a board wager that is usable with the methods of the disclosure.

FIG. 8B is a schematic diagram of another illustrative payout table for a board wager that is usable with the methods of the disclosure.

DETAILED DESCRIPTION

Figure 1A:
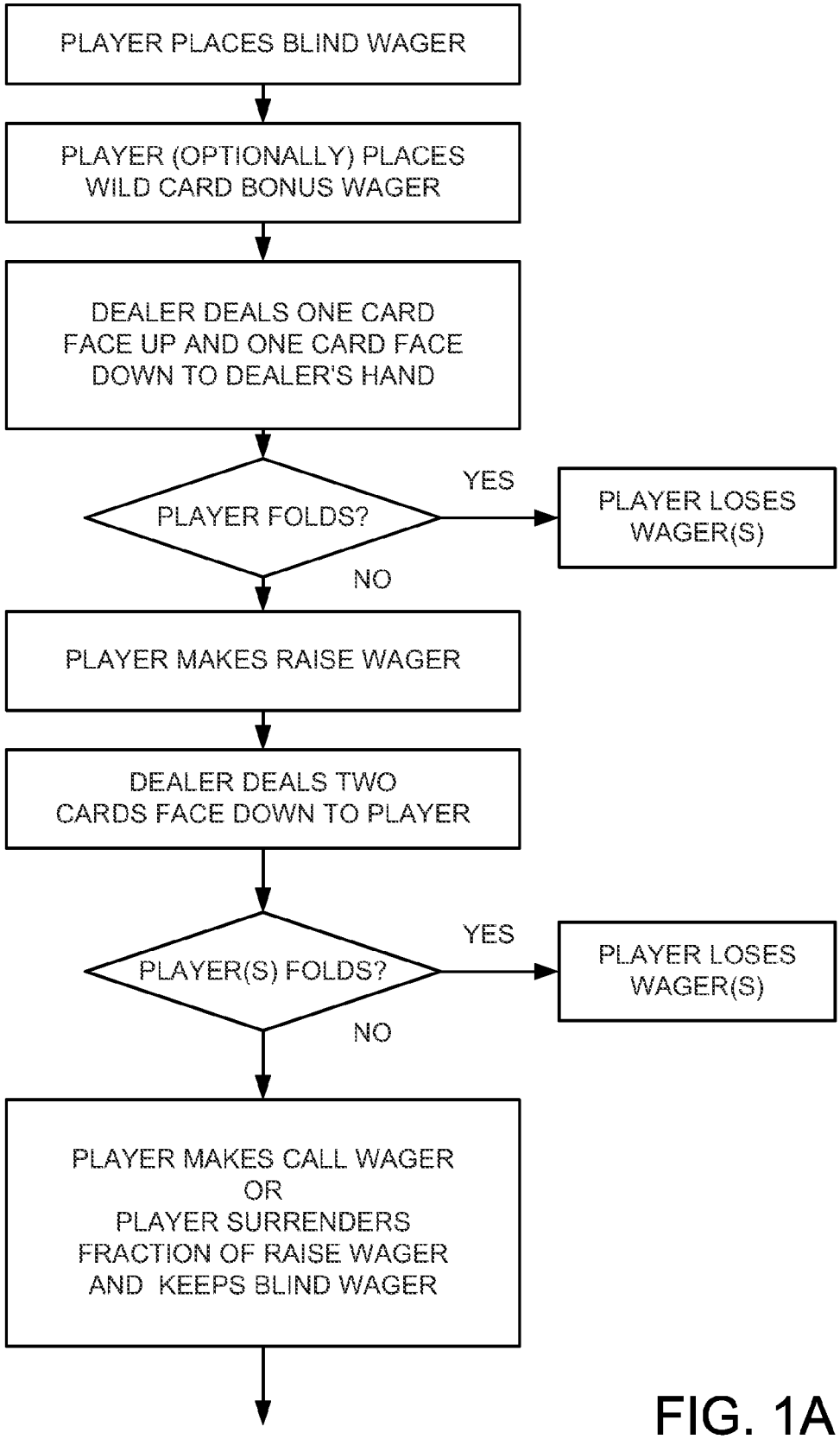
FIG. 1A is a schematic flow diagram of a first portion of one illustrative method of the new method of playing a poker-style game according to one aspect of the present disclosure.

With reference now to the drawings, and in particular to FIGS. 1 through 8 thereof, a new method of playing a poker-style game embodying the principles and concepts of the disclosed subject matter will be described.

One aspect of the disclosure relates to methods for playing a poker-style game between a player 1 and a dealer 2. Although the following description of illustrative implementations of the methods relate to live play between a live human player and a live human dealer, it should be recognized that the disclosure is not so limited and aspects of the methods may be incorporated into apparatus that simulates elements of the method, such as, for example, the playing cards and the betting or wagering devices. The method may thus be implemented in a program of instructions stored on a tangible computer readable medium that is capable of causing a information handling device, such as a computer, to simulate aspects of live play according to the methods set forth or suggested in this disclosure. For example, a gaming console may be provided with a display screen and controls, and a computer receiving input from the controls and generating output for display on the screen.

Live play implementing the method may be facilitated by providing a game apparatus 10 that may include at least one deck of physical playing cards, and in the most preferred embodiments the deck of playing cards includes a standard deck of 52 playing cards with the four suits of numbered and face cards marked on one side of the cards and reverse sides that are indistinguishable from each other. In some of the most favored implementations of the method, at least one joker card is also utilized, and preferably a pair of joker cards may be employed, although this is not necessary. Prior to play, one or more cards of the deck may be declared as a wild card, such that the card may be treated as being of any desired suit and rank for making the best poker hand. When a joker card (or cards) is utilized in play, it may be treated as a wild card.

The apparatus 10 may also a table, or table surface 12, that may be used to facilitate the placement of wagers by distinguishing the wagers placed by the position of the wagering devices, such as betting chips, on the table surface. Markings on the table surface may indicate different positions for wager chips and cards on the table surface. For example, the table surface may have a dealer position and one or more player positions 14. The dealer position may include a place 16 for wagering devices, such as chips, as well as a place 18 for the cards of the dealer's hand. The player's position may include demarcations for placement of the various wagers, as well as a place 20 for a card or cards to be placed for an additional card dealt to the player. The places for the various wagers may include a blind wager spot 22, a raise wager spot 24, and a call wager spot 26. The player position 14 may also include markings for a wild card wager bonus wager spot 28.

Figure 1B:
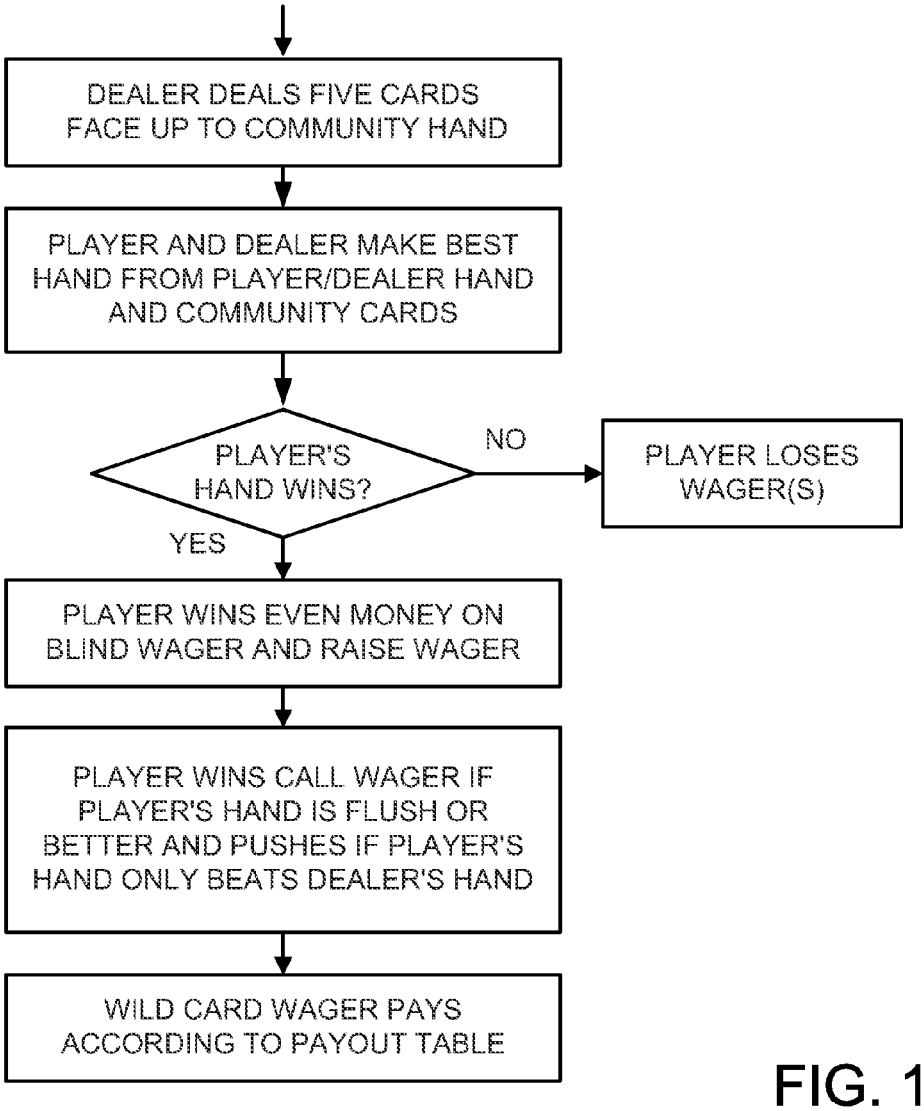
FIG. 1B is a schematic flow diagram of a second portion of the illustrative method of FIG. 1A.

At an initial stage of the game, the method may include placing wagers on the outcome of the game to be played (see FIGS. 1A and 1B). A blind wager may be placed by the player, and received from the player such as by placement of one or more chips on the table surface in a position designated by markings on the table surface. Optionally, in addition to the blind wager, a wild card bonus wager may be placed by the player and received on the table.

Once the initial wager or wagers have been placed, then the dealer may deal cards to an initial dealer hand of the dealer. The dealing may include placing at least one of the cards of the dealers hand in a face up condition, and may include placing at least one card of the dealers hand in a face down condition. In some implementations, two cards total are dealt to the dealer's hand, with one card face up and the other card face down.

Once the dealer's hand has been dealt, and the player has had the opportunity to observe any face up cards in the dealer's initial hand, the player may be provided with the opportunity to place a raise wager, and if the player does not place a raise wager then play of the game may be ended and the previous wager or wagers may be forfeited by the player and collected by the house (such as the blind wager and the wild card bonus wager). In some implementations, the raise wager may be required to be a multiple of the blind wager, such as two times the blind wager, or four times the blind wager, for example.

Cards may then be dealt to an initial player hand if the player has placed a raise wager (and thus not folded), and the cards are positioned face down so that only the player is able to view the indicia on the face of the cards of the player hand. In some implementations, two cards are dealt to the player's initial hand.

After the player has been dealt the cards of the player's initial hand, and the player has had an opportunity to view the cards, a further wager is placed by the player, otherwise the player folds, play ends, and at least a portion of the blind wager, the wild card bonus wager and the raise wager are collected from the player. The further wager may be placed by the player in at least two ways. One way includes placing a call wager by the player by placing the chips of the wager on the table surface (or by whatever manner the wagers are placed). The call wager may be required to be equal to the blind wager placed by the player. Another way of placing the further wager is by the player surrendering to the house a fraction of the previously made raise wager while maintaining the blind wager. In some implementations, the amount of the wager surrendered may be half of the wager, although other fractions may also be used. In this way, the player does not have to add additional value or money to the wager to remain in the game, but has decreased his or her potential winnings by lowering the value of one of the player's earlier bets.

The method continues by the dealer dealing at least one community card in a face up condition, if the player has placed the further wager and has not folded. In most implementations of the method, five community cards are dealt, and are dealt at the same time without any bets being placed between the dealing of the complete number of community cards.

Once the community cards have been dealt, then a ranking of the player's hand may be made by forming the player hand that is the best (or of the highest rank) using a subset or subgroup of the cards of the initial player hand and at least one community card from the community cards placed on the table. Illustratively, the best player hand may be formed using five cards total, including the two cards dealt to the player's initial hand and three cards from cards of the community hand, although use of three community cards is not necessary.

Similarly, a ranking of the dealer's hand may be made by forming the dealer hand of the highest rank possible using a subset or subgroup of the cards of the initial dealer hand and cards from the community cards. As with the player's hand, using the same total number of cards, a hand of five cards is selected using two of the player's cards from the initial dealer hand and three of the community cards that make the highest ranking hand.

Once the best hand is determined for the player and for the dealer, then a comparison may be made between the player hand ranking and the dealer hand ranking to determine a winner between the player and the dealer. If the dealer hand ranking is better than the player hand ranking, at least a portion of the blind, raise and/or call wagers may be lost by the player and collected by the house. If the ranking of the dealer hand is worse than the ranking of the player hand, the player may be awarded an amount proportional to the blind wager and the raise wager, or a combination thereof. In some implementations, the proportion of the wager to the amounted awarded is one to one, although other proportions may be utilized.

In the case of the call wager, the player may be awarded with an amount proportional to the call wager if the ranking of the player hand is a flush or better. If the player hand ranking is better than the dealer hand ranking but not a flush or better, a push may be declared and the wager is returned to the player with no win or loss on the wager.

With respect to the wild card wager, if placed by the player during the game, the player may be awarded an amount that is proportional to the wild card wager. The proportion may vary depending upon the presence of various cards in the player's hand, and may be based upon various pair combinations of cards. Illustratively, the proportions for the various card combinations may be listed in a predetermined payout table that may be marked on the table surface, such as is shown in FIG. 2 of the drawings. The cards usable in determining qualification for the wild card bonus may be limited to those cards of the initial player hand.

Figure 3A:
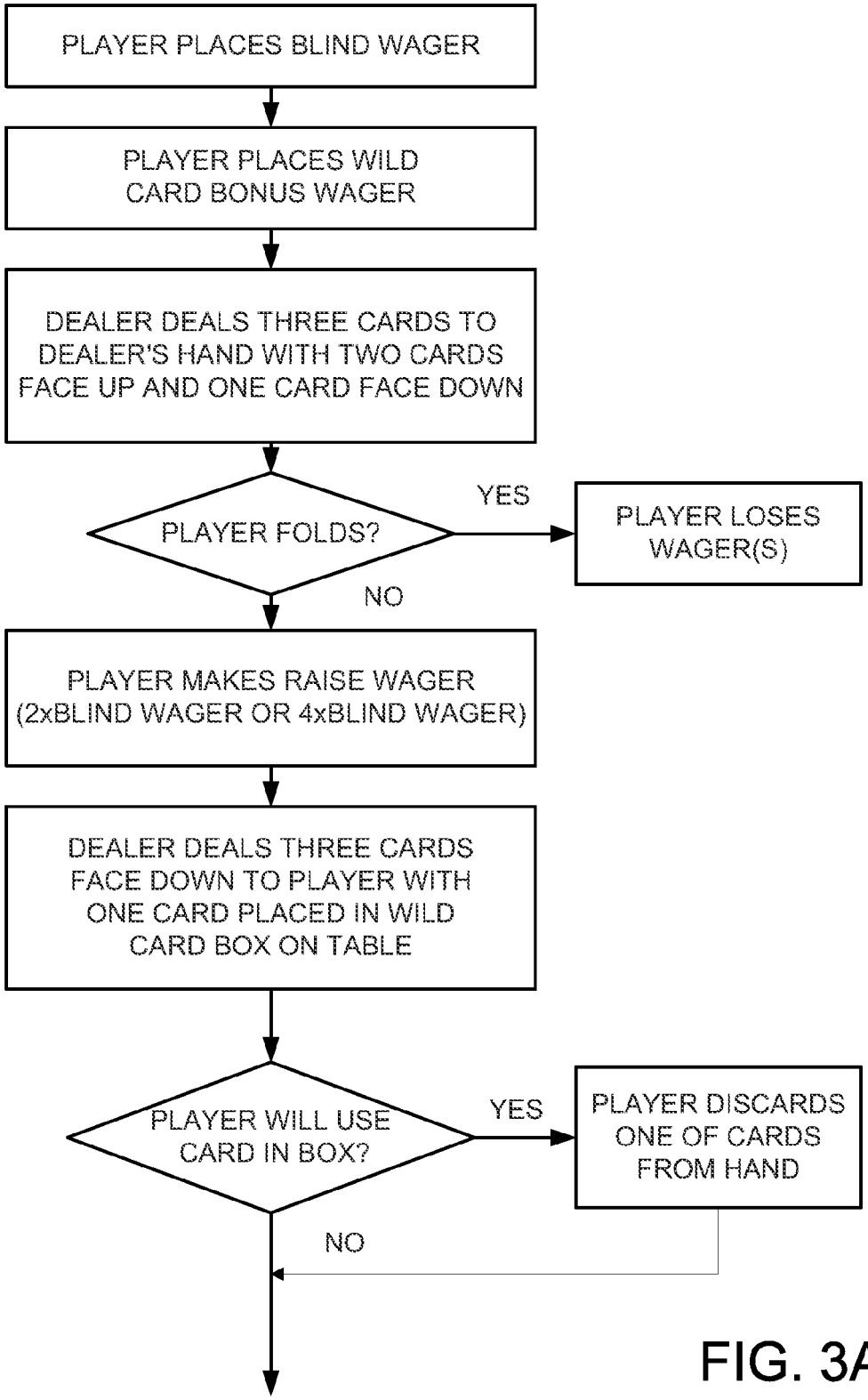
FIG. 3A is a schematic flow diagram of a first portion of another illustrative method of the present disclosure.
Figure 3B:
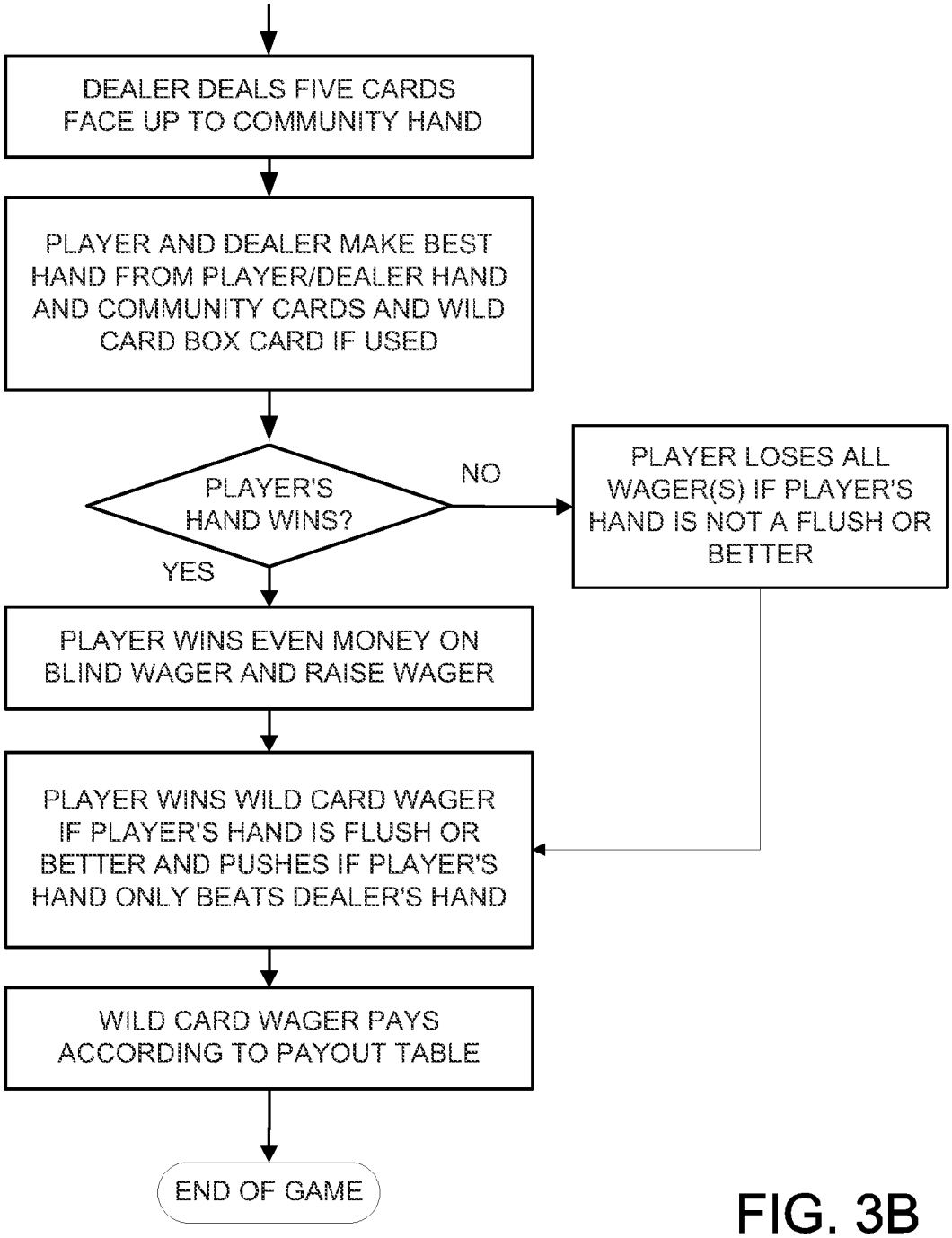
FIG. 3B is a schematic flow diagram of a second portion of the illustrative method of FIG. 3A of the present disclosure.
Figure 4:
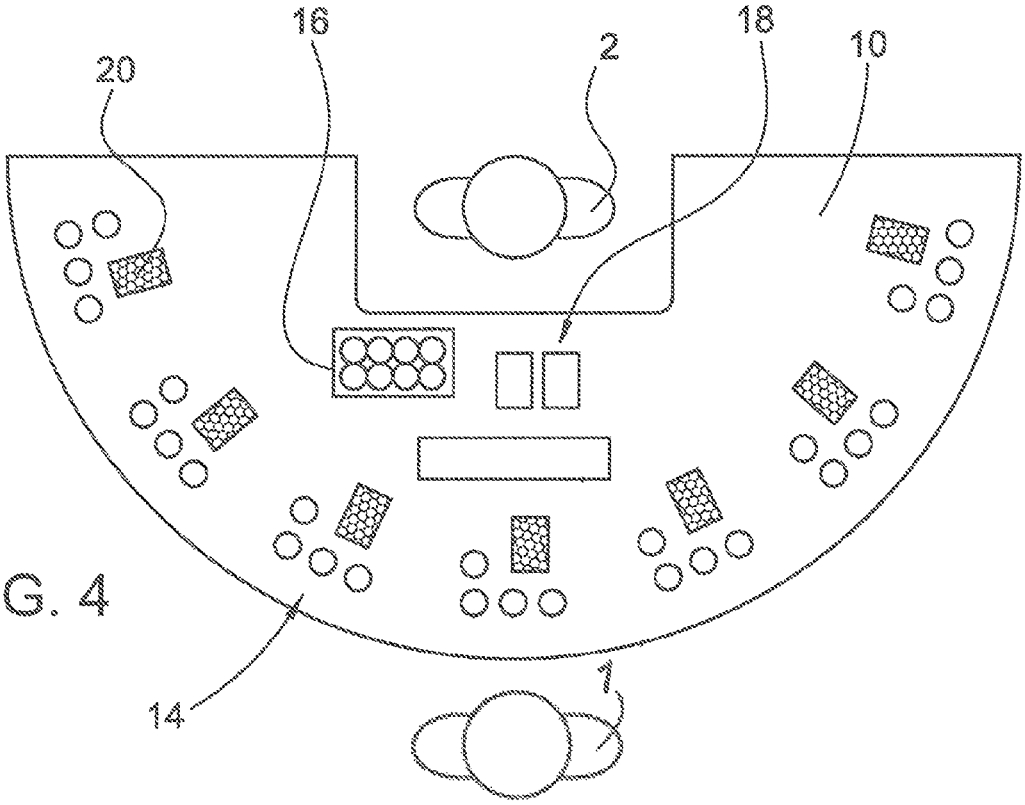
FIG. 4 is a schematic top view of an illustrative table surface with dealer and player positions and various markings, according to an illustrative embodiment.
Figure 5:
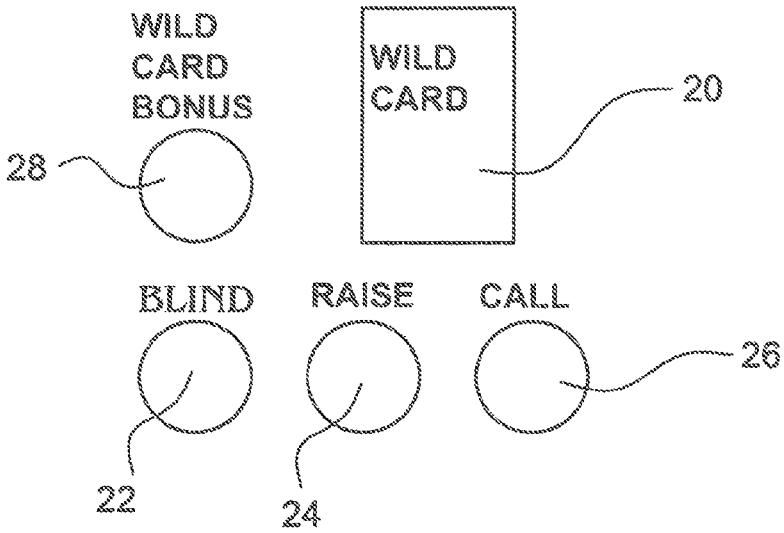
FIG. 5 is a schematic top view of an illustrative player position on the table surface with various markings, according to an illustrative embodiment.

The game may be susceptible to several variations, some of which are shown in the flow diagrams of FIGS. 3A and 3B. For example, participation in the wild card bonus wager may be required, and not optional. As a further option, with respect to the dealer's hand, it may include three cards rather than two, with (for example,) two cards in a face up condition and one card in the face down condition.

A further variation may relate to the cards dealt to the initial player hand. The player may be dealt a number of cards more than two, such as three, but the excess card(s) may be placed in a special designation position, such as a wild card box marked on the table surface. The player has the option of choosing to include the card in the wild card box in his or her hand instead of one of the two cards in the initial hand, and is the player chooses to use the card in the wild card position, then the player may discard the card from his or her hand that is to be replaced by the card from the wild card position.

Upon determining the ranking of the dealer's and player's hands, if the dealer's hand beats the player's hand, then the player may lose all or a portion of the blind wager and the raise wager. It the player's hand beats the dealer's hand, then the player may be paid an amount proportional to the blind and raise wagers, such as, for example, even money on the wagered amounts. With respect to the wild card wager, if the player's hand is not a flush or better, then the player loses the wild card wager. If the player's hand is not a flush or better, but does beat the dealer's hand, then a push is declared and the players wild card bet is returned. If the player's hand is a flush of better, then the player may be paid on the wild card wager according to the combinations and payouts listed in the payout table.

Figure 6A:
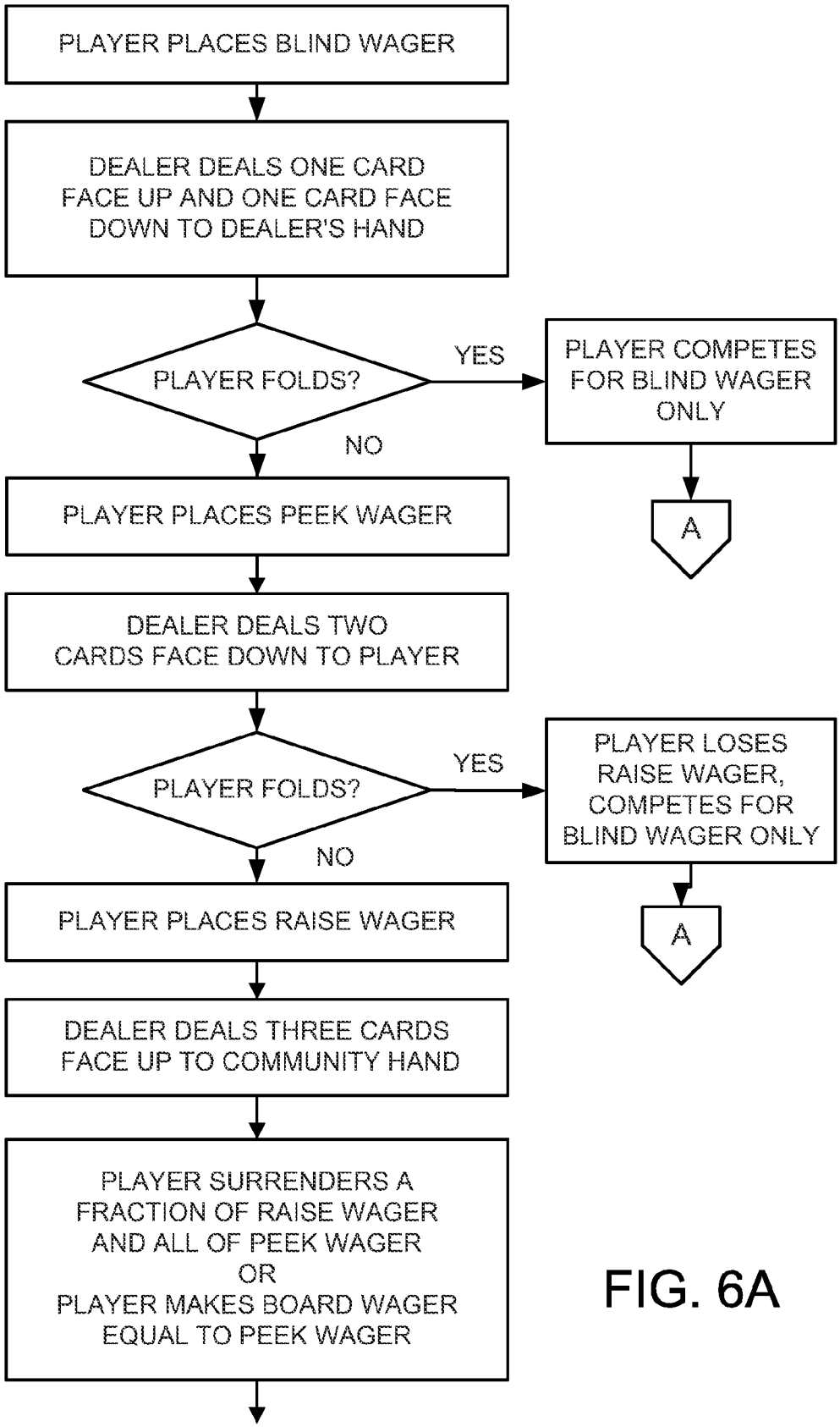
FIG. 6A is a schematic flow diagram of a first portion of another illustrative method of the new method of playing a poker-style game according to one aspect of the present disclosure.
Figure 6B:
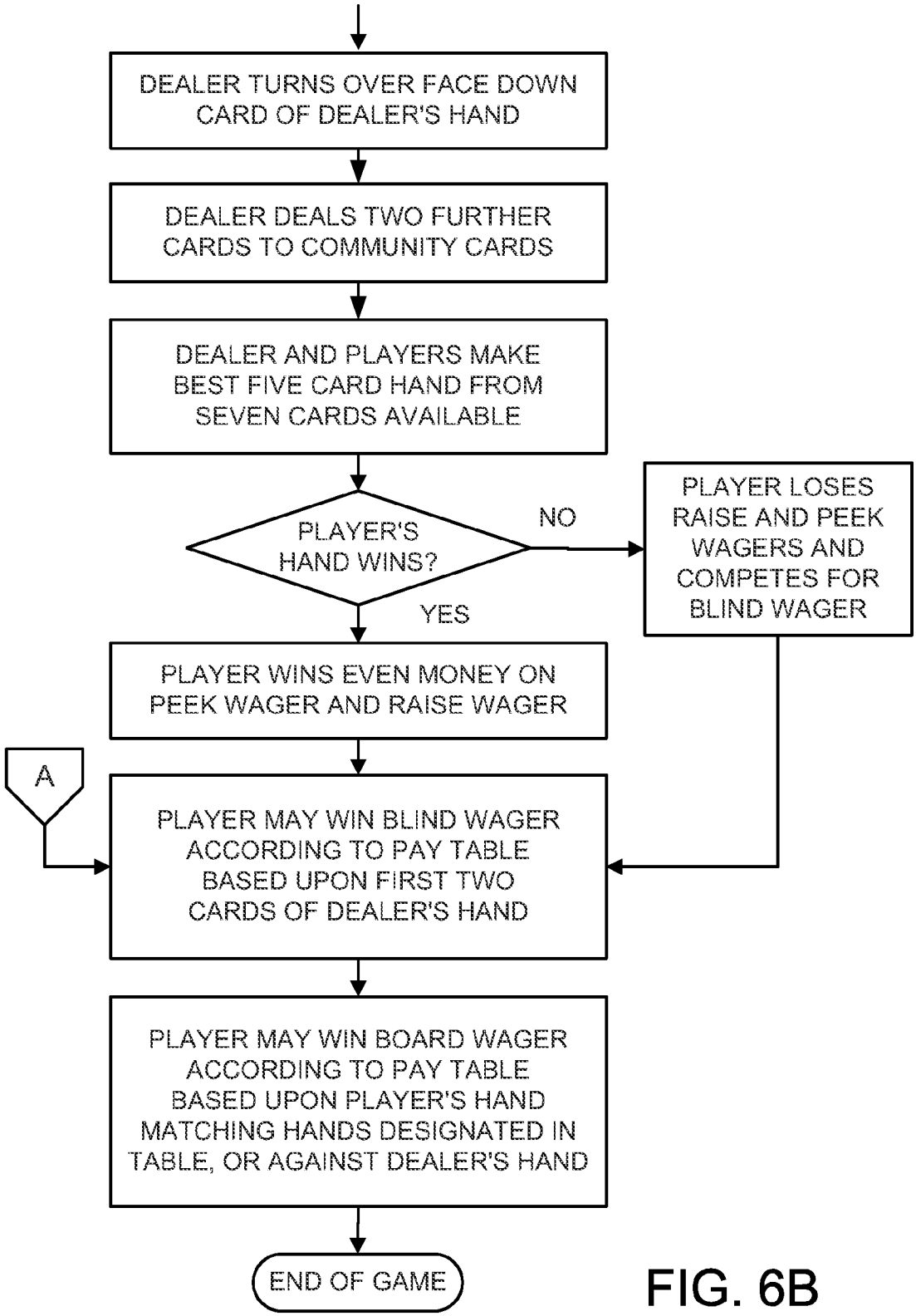
FIG. 6B is a schematic flow diagram of a second portion of the illustrative method of FIG. 6A.

Other implementations of the game methods may introduce variations on the general theme of the games. For example, as shown in FIGS. 6A and 6B, another implementation of the game may include, at an initial stage of the game, the player or players placing wagers on the outcome of the game to be played. A blind wager may be placed by the player or players, and the blind wager may be received from the player in various manners such as, for example, by placement of one or more chips on the table surface. The chip or chips may be placed in a position designated by markings on the table surface to indicate the nature of the bet being placed.

Upon the initial wager or wagers being made, the dealer may deal cards to an initial dealer hand of the dealer, and may include dealing two cards to the hand with one card face up and the other card face down. Once the dealer's hand has been dealt, and the player has had the opportunity to observe any face up cards in the dealer's initial hand, the player may be provided with the opportunity to place a PEEK wager. If the player does not place a PEEK wager, then the player folds for the purpose of the main game of hold 'em but may still be qualified to win on the blind wager made. In some implementations, the PEEK wager may have a required relationship to the blind wager, such as, for example, the amount of the PEEK wager may be required to be equal to or greater than the amount of the blind wager. Any requirement for the PEEK wager may be posted or marked on the table.

Cards may then be dealt to an initial player hand if the player has placed a PEEK wager, and the cards are positioned face down so that only the player is able to view the indicia on the face of the cards of the player hand. Illustratively, the number of cards are dealt to the player's initial hand may be two.

After the player has been dealt the cards and has had an opportunity to view the cards, the player may place a raise wager or fold. If the player folds, the player does not continue to participate in the main game and loses the PEEK wager placed, but the player still retains the ability to collect on the blind wager. The raise wager may be required to have some relationship to a previously placed wager, and in some implementations the raise wager may be required to be a multiple of the PEEK wager. Illustratively, the raise wager may be required to be two or four times the PEEK wager, as some examples.

The method continues by the dealer dealing at least one community card in a face up condition, if at least one player has placed the raise wager such that the main hold 'em game continues. In some implementations, three community cards are dealt after the raise wager or wagers have been placed, and the cards of the community hand are dealt at the same time without any bets being placed between the dealing of the complete number of community cards.

After the dealing of the cards to the community hand, the player has the opportunity to continue participation in the main game. Continued participation may occur in a number of ways, including placement of a further wager, which may be referred to as a board or "I'm in" wager, or by the surrender of a portion of the amounts of the previously placed wagers such that no further wager is made. In the case of the placement of a board wager, the amount of the board wager may be restricted based upon, for example, previous wagers placed by the player. Illustratively, the amount of the board wager may be required to be equal to the amount of the PEEK wager previously made. In the case where the player opts to surrender a portion of the previous wagers rather than make the further board wager, the amount of the surrender of the wagers may vary. Illustratively, the player may be required to surrender the PEEK wager as well as one-half of the raise wager, (The blind wager may be unaffected by the surrender of the other wagers.) Again, by this option the player does not have to wager additional value or money, but the player's potential winnings are decreased by lowering the value of the player's earlier wagers.

Play may continue by the dealer revealing the second card of the dealer's hand by turning over the face down card or cards of the dealer's hand into a face up condition. Further, additional cards may be dealt to the community hand, and illustratively two additional cards are dealt by the dealer to the community hand to add to the previous (two) cards in the community hand.

Upon the dealing of the community cards as well as the revelation of the remaining face down cards of the dealer's hand, then a ranking of the player's hand may be made by forming a hand for the player that is the best (or of the highest rank) using a subset or subgroup of the cards of the initial player hand and the community cards placed on the table. Illustratively, the best player hand may be formed using five cards total, including the two cards dealt to the player's initial hand and three cards from cards of the community hand, although use of three community cards is not required. Similarly, a ranking of the dealer's hand may be made by forming the dealer hand of the highest rank possible using a subset or subgroup of the cards of the initial dealer hand and cards from the community cards. As with the player's hand, using the same total number of cards, a hand of five cards is selected using two of the player's cards from the initial dealer hand and three of the community cards that make the highest ranking hand.

Once the best hand is determined for the player and for the dealer, then a comparison may be made between the player hand ranking and the dealer hand ranking to determine a winner between the player and the dealer. If the dealer hand ranking is better than the player hand ranking, the player may lose the PEEK and raise wagers. If the ranking of the dealer hand is worse than the ranking of the player hand, the player may be awarded an amount proportional to the PEEK and raise wagers (to the extent these wagers were not previously surrendered). In some implementations, the proportion of the wager to the amounted awarded is one to one, although other proportions may be utilized. If the ranking of the dealer and player hands are tied, then a push results with a return of any wagers to the extent not previously surrendered.

The determination of any payout on the blind wager may be made independent of the outcome of the main game, and may include not only the players which participated throughout the main game but also players who folded from the main game but made the blind wager. Payout on the blind wager may depend upon the existence of certain combinations of ranks of cards in the dealer's hand. Illustratively, the payout on the blind wager may be made based upon the initial (two) cards of the dealer's hand. The payout, if any, may be made based upon a predetermined payout table, examples of which are illustrated in FIGS. 7A through 7C. It is possible that during the playoff the game that all players may fold while remain qualified for a payout on the blind wager, which in the most preferred implementations is not lost when the player folds. In this case, the dealer may continue to deal the additional cards to the community hand as well as turning over the card(s) of the dealer's hand that remain face down.

The determination of any payout on the board wager, which is made during the main game, may also be made. The payout on board wager may be made based upon the best hand that can be made from the player's hand, and may also be based upon the relatively rank of the player's hand with respect to the dealer's hand. The payout may be predetermined and listed in a table, such as is illustratively shown in FIGS. 8A and 8B. If the best hand of the player matches one of the hands listed in the payout table, the player may be paid based upon a ratio indicated in the table corresponding to the hand as well as the amount of the board wager made during the main game. If the player's hand does not match any of the hands listed in the table, the player may still win return of the board wager (push) if the player's hand beats or outranks the dealer's hand or ties the dealer's hand. If the player's hand does not tie or outrank the dealer's hand, then the player loses the board wager.

In some implementations of the method, all participating players are required to place the blind wager, and thus the blind wager is not an optional wager. In some implementations, the dealer will discard or "burn" the top card of the deck from which the dealer is dealing before dealing a card to the dealer's hand. The dealer may also burn a card prior to dealing to the players' respective hands, as well as before dealing to the community cards.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features and steps of the various embodiments and implementations described herein may be combined with features of other embodiments and implementations as desired while remaining within the intended scope of the disclosure.

It should further be appreciates that the designation of one of the wagers as a "PEEK" wager is made only to differentiate the wager from the other wagers that may be placed, and is not intended to indicate that there is any descriptive or generic significance to the term "PEEK" in this or related contexts.

In other variations which may be utilized with the above play processes, the dealer may reveal one of the dealer's two hole cards prior to one opportunity for the player(s) to place a wager (or fold), and then may reveal the other of the dealer's two hole cards prior to dealing cards to the player's hands. The player(s) may fold or place a further wager, such as a raise wager of a multiple of the initial or ante wager. Illustratively, the multiple may be two times or four times the initial wager. Three community cards may be dealt, and the player(s) may elect to stay in the game by placing a further wager or surrendering a portion of prior wagers. Additional community cards may be dealt to complete the community hand, and any winnings are paid out to the player(s).

It should be recognized that the game play is not necessarily limited to play with physical cards, and may be utilized on a machine such as a console, desktop or laptop personal computer, tablet computer, personal communication device such as a cellular telephone or "smartphone"), or any other computerized device that may execute a set of instructions, such as instructions embodied in a tangible storage medium as non-transitory signals and executable by a processor, as well as a device that is able to interface and communicate with a network on which a set of instructions stored as non-transitory signals on a storage medium are executable by a processor.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A method of playing a poker-style game between a player and a dealer, the method comprising:

providing a computerized game apparatus for simulating play of a card game including at least one input element and at least one output element, the computerized game apparatus executing instructions to simulate via the input and output elements the steps of:

dealing cards to an initial dealer hand of the dealer if at least one player has placed a blind wager, the dealing including placing at least one card face up and at least one card face down;

dealing cards to an initial player hand of at least one player if said player has placed a PEEK wager;

dealing cards face up to a community card hand if at least one player has placed a raise wager;

turning over the at least one face down card of the dealer's hand if at least one player:

places a board wager; or surrenders a fraction of one of said player's previously placed wagers;

dealing at least one further card face up to the community card hand if at least one player has placed a board wager or surrendered a fraction of one of said player's previously placed wagers;

determining a player hand ranking by forming a best player hand as a subset of the initial player hand and the at least one community card;

determining a dealer hand ranking by forming a best dealer hand as a subset of the initial dealer hand and the at least one community card; and comparing the player hand ranking and the dealer hand ranking to determine a winner.

2. The method of claim 1 additionally comprising collecting at least a portion of any PEEK and raise wagers placed by the player if the dealer hand ranking is better than the player hand ranking.

3. The method of claim 1 additionally comprising awarding the player an amount proportional to the PEEK wager and the raise wager, or a combination thereof, if the dealer hand ranking is worse than the player hand ranking.

4. The method of claim 1 additionally comprising awarding the player with an amount proportional to the board wager if the player hand ranking is a flush or better.

5. The method of claim 1 additionally comprising awarding the player with an amount proportional to the blind wager using a predetermined payout table based upon cards of the initial dealer hand if cards of the dealer's initial hand match one card combination set forth in the table.

6. The method of claim 5 wherein a player is permitted to win the blind wager regardless of whether said player folds without placing any wager in addition to the blind wager.

7. The method of claim 1 additionally comprising awarding the player with an amount proportional to the board wager using a predetermined payout table based upon cards of the best player hand.

8. The method of claim 1 wherein dealing cards to an initial player hand includes dealing two cards to the initial player hand.

9. The method of claim 1 wherein dealing cards to the initial dealer hand includes dealing two cards with one card face up and one card face down.

10. The method of claim 1 wherein determining the player hand ranking includes forming the best player hand with two cards of the initial player hand and three cards from cards of the community hand; and wherein determining the dealer hand ranking includes forming the best player hand with two cards of the initial dealer hand and three cards from cards of the community hand.

11. The method of claim 1 additionally comprising awarding the player an amount proportional to the blind wager and the raise wager, or a combination thereof, if the dealer hand ranking is worse than the player hand ranking.

12. The method of claim 1 additionally comprising declaring a push if the player hand ranking is better than the dealer hand ranking but the player hand ranking is not a flush or better.

13. The method of claim 1 additionally comprising receiving a wild card wager from the player prior to dealing the initial player hand of the player, and awarding the player with an amount proportional to the wild card wager using a predetermined payout table based upon cards of the initial player hand if the players initial hand matches one of more than two card combinations set forth in the table.

14. The method of claim 1 wherein dealing cards to the initial player hand of the player includes placing at least one of the cards in a wild card box; and determining by the player if the player will use the card placed in the wild card box.

15. The method of claim 14 wherein, if the player decides to use the card in the wild card box, requiring the player to discard one of the cards from the initial player hand.

16. The method of claim 15 wherein dealing cards to the initial player hand includes dealing two cards to the player's hand and one card to the wild card box.

17. The method of claim 1 wherein surrender of the fraction of the raise wager further includes maintaining the blind wager.

18. A method of playing a poker-style game between a player and a dealer, the method comprising:

providing a computerized game apparatus for simulating play of a card game including at least one input element and at least one output element, the computerized game apparatus executing instructions to simulate via the input and output elements the steps of:

requiring one or more players to place a blind wager;

dealing cards to an initial dealer hand of the dealer, the dealing including placing at least one card face up and at least one card face down;

dealing cards to an initial player hand of at least one player;

dealing cards face up to a community card hand;

turning over the at least one face down card of the dealer's hand;

receiving any further wagers from the one or more players;

dealing at least one further card face up to the community card hand if at least one player has placed a further wager;

determining a player hand ranking by forming a best player hand as a subset of the initial player hand and the at least one community card;

determining a dealer hand ranking by forming a best dealer hand as a subset of the initial dealer hand and the at least one community card;

comparing the player hand ranking and the dealer hand ranking to determine a winner; and awarding the player with an amount proportional to the blind wager using a predetermined payout table based upon cards of the initial dealer hand if cards of the dealer's initial hand match one card combination set forth in the table, a player being permitted to win the blind wager regardless of whether said player folds without placing any wager in addition to the blind wager.

19. The method of claim 18 wherein additionally requiring a player to place a PEEK wager for said player to be dealt cards for the player's hand; and requiring at least one player to place a raise wager for cards to be dealt to the community card hand.

* * * * *